United States Patent [19]

Redmond

[11] 3,986,640

[45] Oct. 19, 1976

[54] PACKAGE FOR A FLOWABLE PRODUCT AND MATERIAL FOR MAKING SUCH PACKAGE

[76] Inventor: Sanford Redmond, 1385 York Ave., New York, N.Y. 10021

[22] Filed: Mar. 5, 1975

[21] Appl. No.: 555,683

Related U.S. Application Data

[63] Continuation of Ser. No. 389,503, Aug. 20, 1973.

[52] U.S. Cl. ..... 222/92; 222/541; 206/498

[51] Int. Cl.[2] ..... B65D 35/00

[58] Field of Search ..... 222/92, 107, 541, 542, 222/527–529; D9/182, 183, 192; 401/132; 15/104.93, 104.94; 206/498, 484

[56] References Cited

UNITED STATES PATENTS

| | | | |
|---|---|---|---|
| 2,499,313 | 2/1950 | Hoag | 222/541 |
| 3,263,863 | 8/1966 | Hoag | 222/541 |
| 3,451,539 | 6/1969 | Wysocki | 206/56 AA |
| 3,472,368 | 10/1969 | Hellstrom | 206/56 AA |
| 3,750,907 | 8/1973 | Steele | 222/107 |
| 3,759,371 | 9/1973 | Marks | 206/42 |

*Primary Examiner*—Robert B. Reeves
*Assistant Examiner*—H. Grant Skaggs

[57] ABSTRACT

A package for a flowable product and material for making such a package in which the package includes a relatively stiff, but flexible material and a flexible material between which the flowable product to be packaged is contained and around which flowable product the materials are affixed to each other, the relatively stiff, but flexible material being cut through or partially through in an interrupted pattern and, when cut through, at least one side of the relatively stiff, but flexible material, at least in the area of the cut pattern, being covered with a sealant, which sealant preferably is a foil, the package, when bent, opening up along the cut pattern to dispense the flowable product from the package, and the relatively stiff, but flexible material for making such a package.

23 Claims, 22 Drawing Figures

FIG.2.
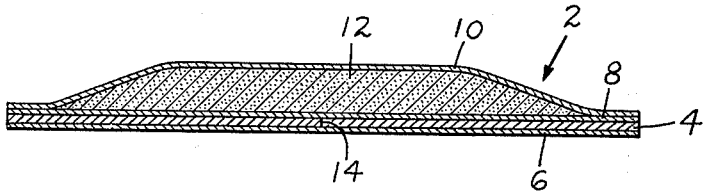
FIG.3A.
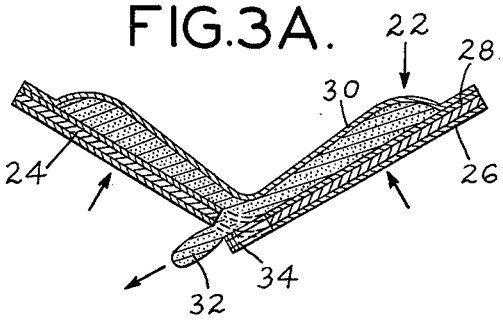
FIG.3D.
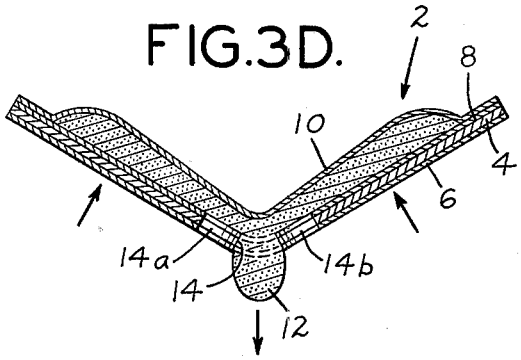
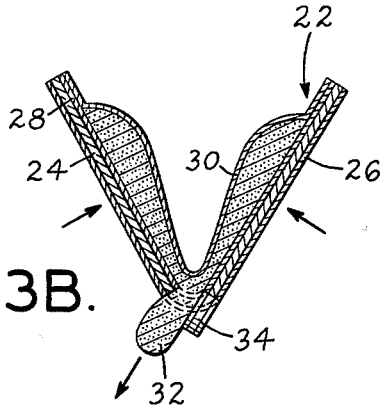
FIG.3B.
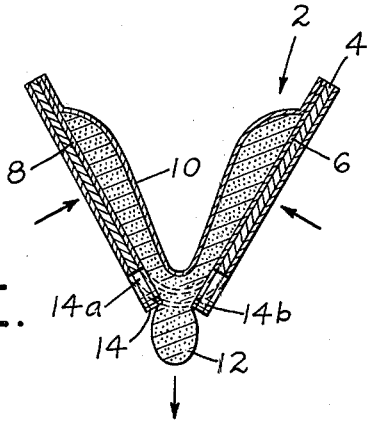
FIG.3E.
FIG.3C.
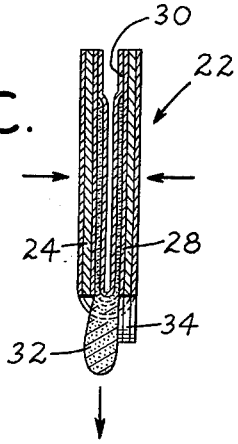
FIG.3F.
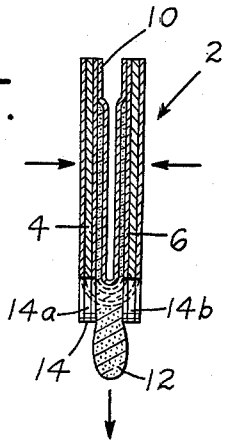

PACKAGE FOR A FLOWABLE PRODUCT AND MATERIAL FOR MAKING SUCH PACKAGE

This is a continuation of application Ser. No. 389,503, filed Aug. 20, 1973.

This invention relates to a package for a flowable product and to materials for making such a package. More particularly, the invention relates to such a package from which the flowable product can be packaged and dispensed in the quantity in which such product is normally dispensed and to materials from which such packages can be made.

Various attempts have heretofore been made to provide a package into which a flowable product may be packaged in the quantity in which such material will be normally dispensed and from which package such product might be dispensed. Such packages have been made from a wide variety of materials and include cups or containers of plastic or coated material closed with a plastic cover or covers made of other materials, or packages made from sheets of relatively thin plastic, sometimes laminated with other plastics or with foil, between which the flowable product is packaged and around which flowable product the sheets are sealed to each other. In each type of package, the cup of container type and the type formed with sealed, relatively thin sheets, the opening of the packages and dispensing of the flowable product is difficult.

The cup or container of plastic material closed with thin plastic or foil is most commonly used for packaging cream, jelly, marmalade, and the like. These packages are relatively expensive, sometimes costing more than the material packaged therein. Furthermore, such packages are often difficult to open. The seal between the cup and thin cover is difficult to break, the thin cover frequently rips during opening and the flowable contents within the cup or container often spill or is difficult to remove because of the partially removed, torn cover. With cream, for example, it is most uncommon for some of the cream to be spilled as the container is being opened. Because of this and the cost, such containers have met with limited acceptance and even then for institution use as distinguished from home and general use.

The container formed with thin sheets, sometimes laminated with foil or other material, while less costly than the cup or container type package, are often difficult to open and once opened the contents are difficult to remove. Such containers of thin plastic sheets are commonly used for packaging condiments such as ketchup and mustard. In order to open such a package, the sheets must be ripped through the sealed edge and across the envelope in which the flowable material is contained. This is usually done at one end of the package. However, such ripping of the package, through the sealed edge and across the envelope, is often difficult to accomplish. Moreover, while the package is being ripped, the contents tend to be squeezed out of and flow from the package resulting in waste of the packaged product and inconvenience to the user.

The package of the instant invention and the materials of such invention overcome the problems heretofore encountered with cup or container packages and containers of thin sheets as heretofore employed. In the instant invention, the package is formed by superimposing a sheet of relatively flexible material over a sheet, web or card of relatively stiff but flexible material with the product to be packaged between the sheets. The sheets are joined to each other outside of the margin of the product being packaged such as, for example, by heat sealing. Such joining of the flexible sheet material to the relatively stiff sheet material may be accomplished with the product being packaged therebetween or the flexible sheet material and relatively stiff sheet material may be partially sealed to form a pouch which might then be filled with the product to be packaged and the seal around the product might then be completed.

In the packaging of the instant invention, the relatively stiff material which, when the package is formed, forms one of the faces of the package, is cut through or partially through. The cut is made in a pattern where the relatively stiff material will be bent and folded when the package is to be opened. After the relatively stiff material is cut or partially cut, such material may be calendered. The calendering smoothes the opposite faces of the material. After the relatively stiff material is cut, the relatively stiff material may be coated or covered, at least in the cut area and on at least one side, with a sealant such as a plastic, a wax or a foil. The sealant may be applied as a liquid, sufficient sealant should be applied to bridge over and form a cover across the cut at the surface to which the sealant is applied. For reasons which will be apparent hereinafter, the sealant should form a seal over the cut sufficient to prevent wicking or seepage through the cut and absorption or wetting of the relatively stiff material but, at the same time, should be of a tensile strength which, when the relatively stiff material is bent, will rupture at or closely adjacent to such cut. The relatively stiff material may be of a plastic, such as extruded polystyrene or copolymer with polystyrene, and may be partially cut through so that, when bent, the material will rupture at or closely adjacent to such cut. When formed of such a plastic material and partially cut therethrough, the use of a sealant may not be necessary.

As has already been mentioned, the product being packaged is positioned and held between the faces of the relatively stiff material and the flexible material. The materials are sealed to each other around the product. To remove and dispense the product, the container is bent or folded at the cut pattern. The flexible material sides of the container at the opposite sides of the cut are folded to contact each other. As the package is folded, the cut relatively stiff material ruptures the sealant at the cut. Where partially cut through, the relatively stiff material ruptures at or adjacent to the cut. The edges of the cut open up. This rupturing and opening of the edges allows the produuct, packaged in the container between the flexible and the relatively stiff materials, to flow out of and be discharged from the package. By compressing the folded container, one flexible side against the other, by squeezing or applying force to the folded relatively stiff material, the product contained in the package can be squeezed out of and discharged from the package.

The package of the instant invention may be employed for the packaging of fluid substances having a broad range of viscosity and solids in particulate or granular state. The package is suited for the packaging and dispensing of materials, such as, pastes, gels, liquids and granular materials such as powders and detergents.

The instant invention will be more fully understood from the following description and appended drawings of preferred embodiments in which:

FIG. 2 is a sectional view, in elevation, taken along line 2—2, FIG. 1A;

Figure 1A:
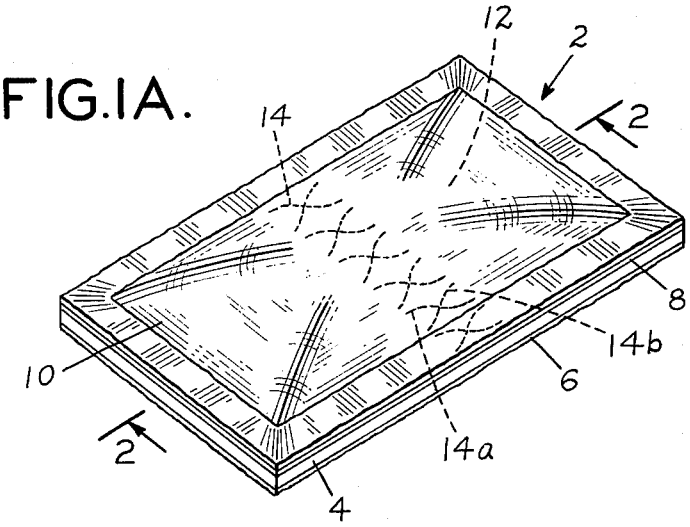
FIG. 1A is a perspective view taken from the top of the container of the instant invention and showing one embodiment thereof.
Figure 1B:
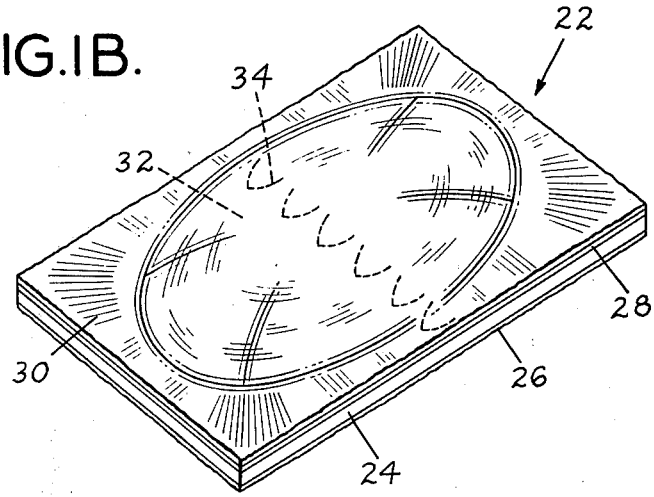
FIG. 1B is a perspective view, similar to FIG. 1A, but showing a modification of the invention.
Figure 5:
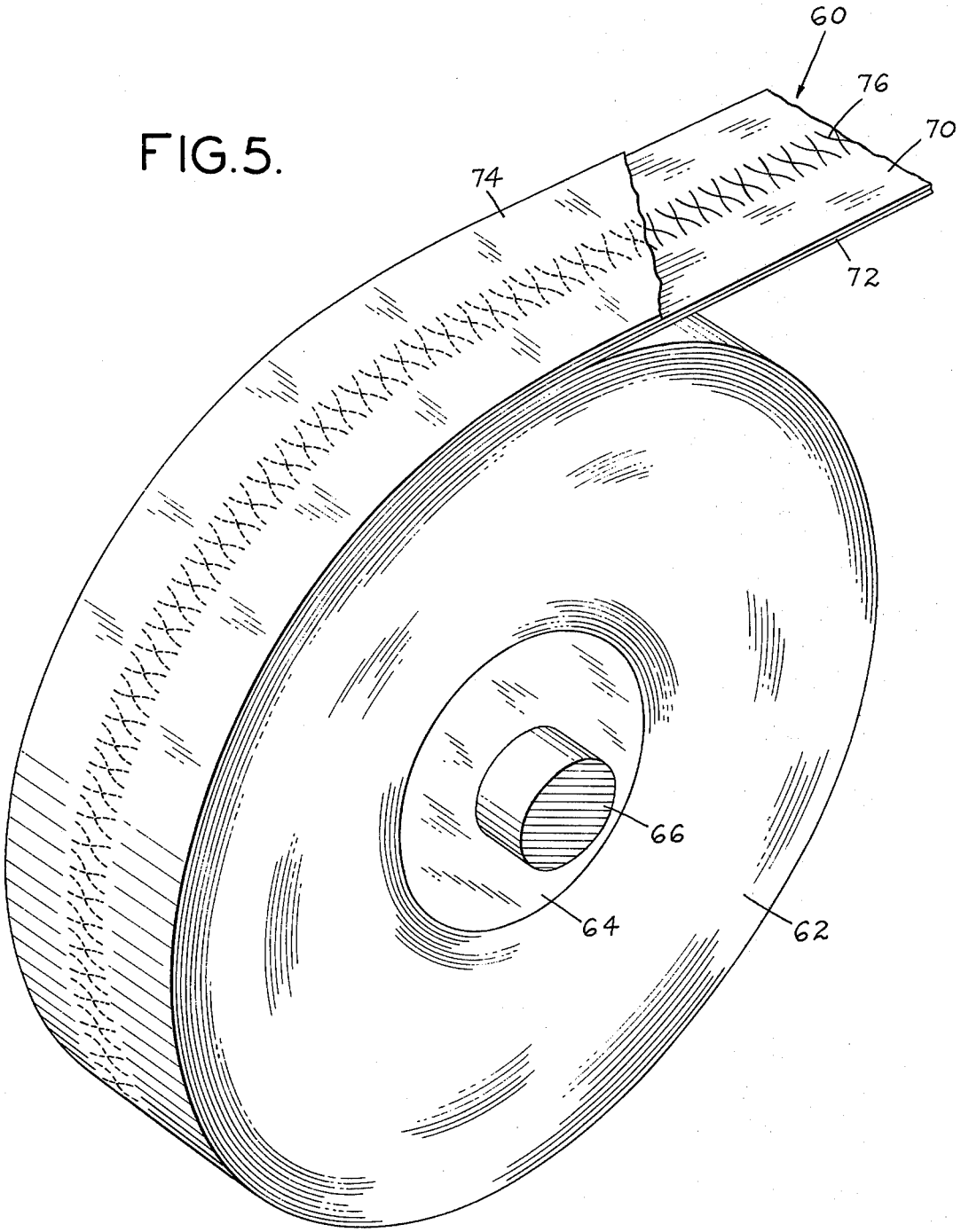
Figure 6A:
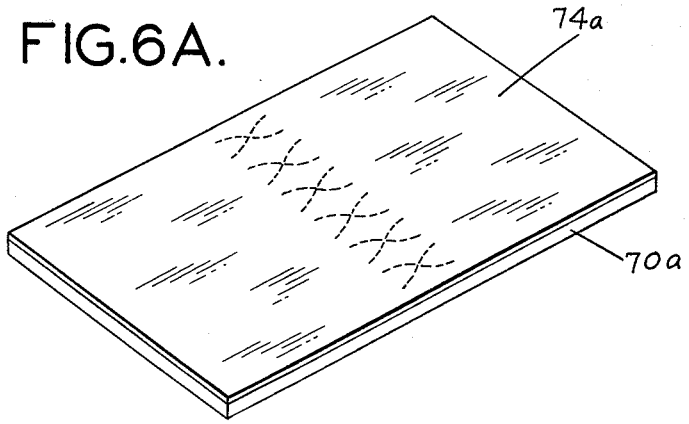
Figure 6B:
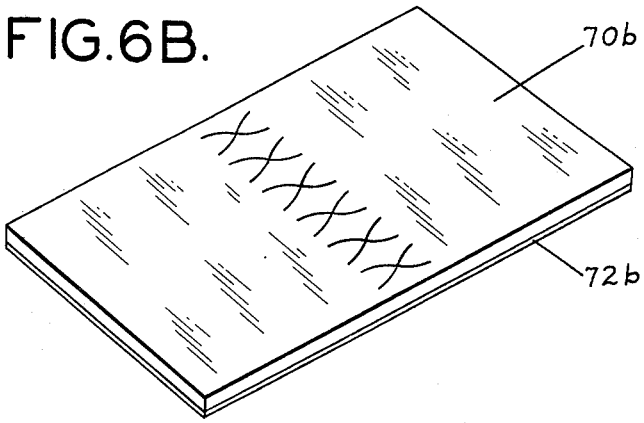
Figure 6C:
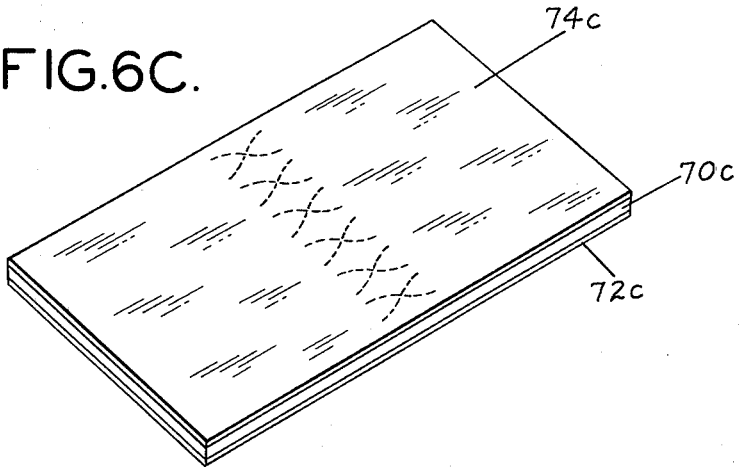

FIGS. 3A, 3B, and 3C are sectional views of the embodiment of FIG. 1B and showing the container of FIG. 1B in various positions as the container is folded;

FIGS. 3D, 3F and 3F are sectional views, similar to FIGS. 3A–3C but showing the embodiment of FIG. 1A at various stages of folding;

FIGS. 4A through 4H are plan views of the relatively stiff material employed in the instant invention, each FIG. showing a modification of the cut pattern;

FIG. 5 is a perspective view of a roll of the relatively stiff material utilized in the instant invention;

FIG. 6A is a perspective view of the relatively stiff material showing one of the cut embodiments with a sealing layer applied to one of the surfaces of the material;

FIG. 6B is a perspective view, similar to FIG. 6A but showing the sealing layer applied to the opposite face of the material and;

FIG. 6C is a perspective view, similar to FIG. 6A and 6B, but showing the sealing layer applied to both surfaces of the material.

Referring to the drawings and particularly FIG. 1A and FIG. 2 showing one embodiment of the invention, the package, generally designated 2, includes a sheet of relatively stiff material 4, covered at its opposite sides with sealant 6, 8, such as by wax or a suitable plastic, applied as a liquid or as a film and adhering to material 4. Sealant 6, 8 may be a metal foil coated on one or both sides ad adhesively fixed or heat sealed to material 4. Flexible sheet material 10 is adhesively fixed to sealant 8 and material 4 around the marginal edges of sheet materials 4, 10 and around product 12 packaged therein. Relatively stiff sheet material 4 is cut through or partially through at 14 in an interrupted pattern extending across sheet material 4, in two opposing rows **14*a* and 14*b*. As will be described in more detail later herein, sheet material 4 is cut through a partially through before sealant 6, 8** is applied to the opposite faces thereof.

Referring to FIG. 1B showing another embodiment, the package, generally designated 22, includes a sheet of relatively stiff material 24, covered at its opposite sides with sealant 26, 28 of wax or a suitable plastic, applied as a liquid or as a film and adhering to material 24. Sealant 26, 28 may be a metal foil coated on one or both sides and adhesively fixed or heat sealed to material 24. Flexible sheet material 30 is adhesively fixed to sealant 28 and material 24 around the marginal edges of sheet materials 24, 30 and around product 32 packaged therein. Relatively stiff sheet material 24 is cut through or partially through at 34 in an interrupted pattern extending across material 24, the cut pattern being formed before sealant 26, 28 is applied to material 24.

Figure 1C:
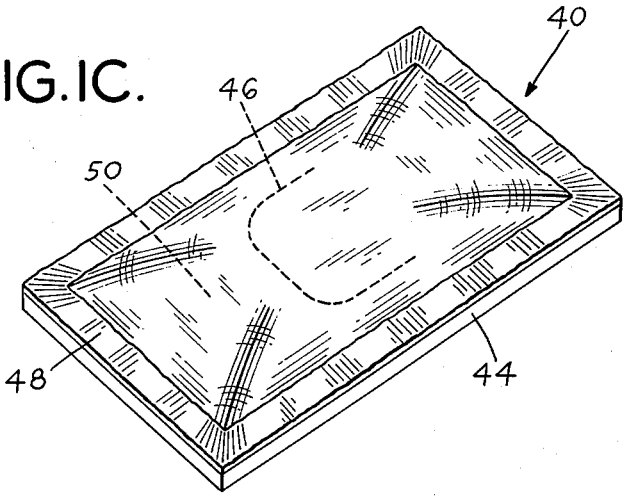
FIG. 1C is a perspective view, similar to FIGS. 1A and lB, but showing a further modification.
Figure 4A:
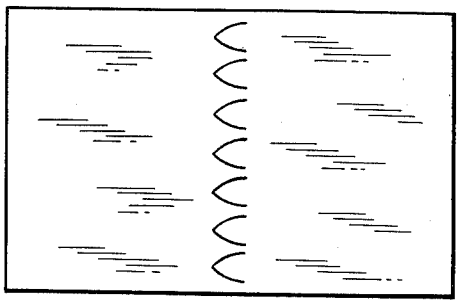
Figure 4B:
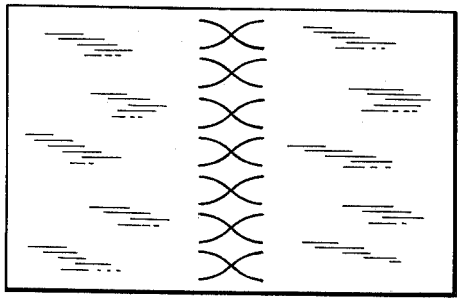
Figure 4C:
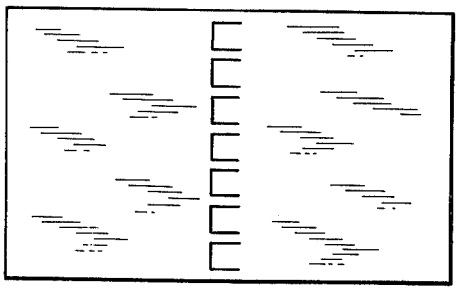
Figure 4D:
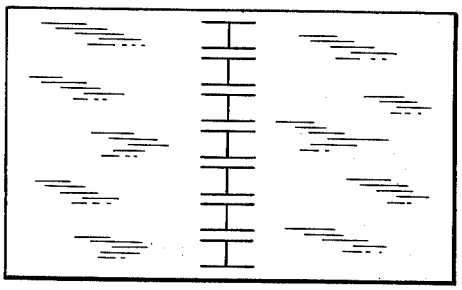
Figure 4E:
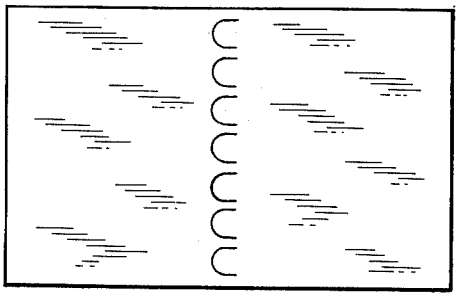
Figure 4F:
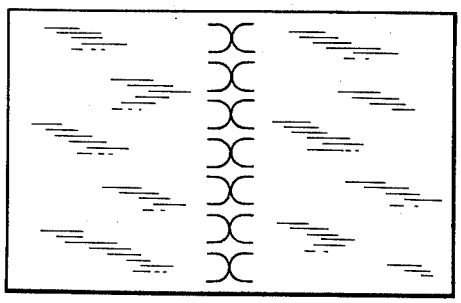
Figure 4G:
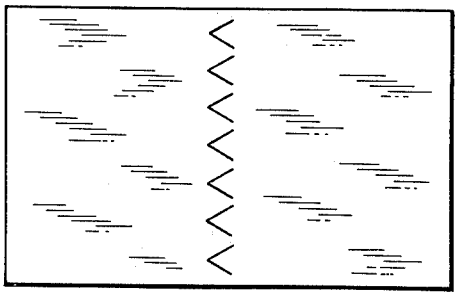
Figure 4H:
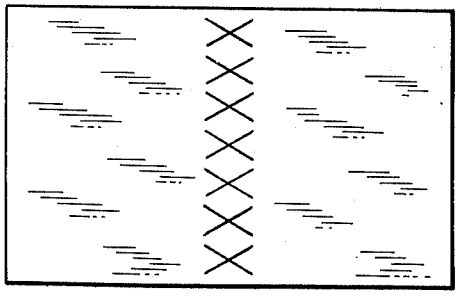

FIG. 1C shows a further modification of the invention, in which the package, generally designated 40, includes a relatively stiff but flexible sheet 44, such as of a plastic, for example, extruded polystyrene or a copolymer of polystyrene, partially cut through at 46. Flexible sheet material 48 is adhesively fixed to material 44, such as by heat sealing, around product 50 packaged therein.

As best shown in FIGS. 3D, 3E, package 2 of FIGS. 1A and 2 is opened by folding package 2 around out pattern 14 and by bringing the opposite faces of flexible material 10 at the opposite sides of cut pattern 14 into contact with each other as shown in FIG. 3F. As package 2 is bent and folded, sealant 6, 8 at cut pattern 14 is ruptured. Opposed cuts **14*a*, 14*b* open up, forming therebetween an opening through which material 12, which may be a liquid, paste, gel, powder or granular material, flows. As the opposite faces of flexible material 10 are brought into contact with each other and pressure is applied to the product in package 2 by pressing the sides of relatively stiff material 4, product 12 which is then in package 2 can be squeezed out. This can be accomplished without touching or coming into contact with product 12.**

In FIGS. 3A, 3B and 3C opening of the embodiment of FIG. 1B is shown. In this embodiment, as in the other embodiments of the instant invention, the relatively stiff material is bent and folded, rupturing the material at the cut, in this embodiment at 34, and material 32 is caused to flow through the ruptured cut. Because in the embodiment of FIGS. 1B, 3A, 3B and 3C, the cut pattern is in a single row, a smaller opening or discharge is formed when cut 34 is ruptured and the cut opens. Such a single row cut pattern is best suited for packaging and dispensing of more liquid materials or where a slower discharge of the product is desired.

The flow and dispensing of products packaged in accordance with the instant invention and the discharge pattern of such products can be controlled by the size and spacing of the cuts formed through or partially through the relatively stiff, but flexible, material. Such cuts may be formed in a single row, a double row or a plurality of rows spaced so as to maintain the integrity of the relatively stiff material in the package but to rupture and open up when the package is folded or bent. A variety of such cut patterns, in single and in double rows are shown in FIGS. 4A through 4H.

The relatively stiff, but flexible material used to form one side of the package of the instant invention may be made from a wide variety of materials such as cardboard, fiberboard, paperboard or plastic and may be made in the size in which it will be used in the package or may be made in a continuous strip from which package size cards might then be cut. For ease of manufacture, handling and storage and for use on many types of packaging machinery, it is preferred to make such relatively stiff, but flexible material in a continuous strip and to form such continuous strip into a coil or roll from which the material might be dispensed and cut into package size cards as its use is required.

As best shown in FIG. 5, the relatively stiff, but flexible material, generally designated 60, is in a roll or coil 62 on core 64 and is mounted to be fed from the roll on shaft 66. Base 70 of material 60 may be cardboard, fiberboard, paperboard or plastic. When made from an absorbent or easily soiled material, such as cardboard, fiberboard or untreated paperboard, the surface of base 70 which, when the package is made, forms one of the outer surface of the package may be coated with a sealant, such as at 72, to protect the outer package surface and so that such package will remain clean and attractive. Such sealant 72 should be sufficient to protect the surface but should be sufficiently weak, when the package is bent, so as to avoid interference with the rupture of base 70 when the cut through or partially cut through base is bent and folded.

On its opposite surface, at 74, base 70 is covered with a sealing layer which, in the preferred embodiment of the invention is a foil. Foil is preferred because it is compatible with most products for which the package of the instant invention may be utilized for packaging, is impervious to air and vapors and forms an effective barrier over cut pattern 76 extending longitudinally along base 70. Pattern 76 is cut into base 70 before sealant 72 or foil 74 is applied to the base.

The relatively stiff, but flexible material 60 is fed from the roll and, depending upon the desired direction of the cut pattern in the package, is cut transversely into cards of the required width or length. The width of material 60 in roll or coil 62 is such that, when cut transversely, a card of desired width or length for the package is produced.

Referring to FIGS. 6A, 6B and 6C, the relatively stiff, but flexible material utilized to form one side of the package of the instant invention and shown in the form of a roll or coil 62 in FIG. 5, may be coated or covered with a sealant or covered with a foil adhesively or heat sealed thereto on one or both sides. Where a foil is employed and the flexible sheet, such as sheets 10, 30 or 48, FIGS. 1A, 1B and 1C are to be adhesively affixed around the product, the surface of such foil to be contacted with and heat sealed to the flexible sheet is preferably coated with a heat sealable material such as a thermoplastic lacquer.

As shown in FIG. 6A, base 70*a* is coated or covered on its upper surface, at 74*a*, with a sealant or covering of foil, such sealant or foil covering being on the surface of base 70*a* upon which the product to be packaged will be in contact and being compatible with such product. In FIG. 6B, base 70*b* is coated or covered on its under surface, at 72*b*, with a sealant or covering of foil. Because, when the package is formed, the under surface will not be in contact with the product, such sealant or foil covering need not be compatible with the product to be packaged. In FIG. 6C, base 70*c* is coated or covered on its opposite surfaces, at 72*c* and 74*c* with a sealant or covering of foil. Where, as for example, the stiff, but flexible material is of a plastic such as polystyrene or a copolymer thereof and the cuts of the cut pattern extend only partially through the material, use of a sealant or foil covering on one or both faces of the material may not be necessary. In such an arrangement, the plastic material may be compatible with the product to be packaged and such material is not easily soiled.

The flexible material, such as 10 in FIGS. 1A and 2, may be of flexible plastic sheeting, paper, coated paper or of any of the coated or uncoated flexible materials commonly used for wrapping. Such material should, of course, be compatible with the product being packaged and the system for affixing such flexible material to the relatively stiff but flexible material, such as material 4 of FIGS. 1A and 2 and sealant 6, 8 thereon. When such materials are to be affixed by heat sealing, a thermoplastic material is preferred.

The package of the instant invention is relatively inexpensive to form and the materials thereof are not expensive. Moreover, in the package of the instant invention, the package is opened and the product packaged therein is dispensed in a single operation. Thus, by the simple bending of the package about the axis of the cut pattern and the bringing of the flexible sides of the package into contact with each other, at the opposite sides of the axis of the cut pattern, the package is opened and the packaged product is dispensed. The size, shape and spacing of the cuts extending through or partially through the relatively stiff but flexible material can be selected so as to dispense the packaged product in a wide variety of flow patterns.

The terms and expressions which have been employed are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A dispensing package for a flowable substance, said package having a relatively stiff flat side and a flexible arched side secured to one side of said stiff flat side and forming between said stiff flat side and said flexible arched side a pocket for containing a flowable substance, said relatively stiff flat side having a cut pattern so as to form at least one tongue and one opening when said relatively stiff flat side is bent into a V about an axis through the base of said tongue and in a direction about said axis toward said pocket so that said flexible arched side and said flowable substance in said pocket are between the arms of said V, said arms of said V and said flexible side therebetween cooperating, as said arms are forced toward each other, and applying pressure on said flowable substance in said pocket and forcing said flowable substance to flow from said pocket through said opening.

2. A package, as recited in claim 1, in which said cut pattern is an interrupted series of cuts forming a series of tongues extending across said stiff flat side.

3. A package as recited in claim 2, in which said interrupted pattern is repeating.

4. A package, as recited in claim 1, in which said stiff flat side is cut through in interrupted spaced cut patterns.

5. A package, as recited in claim 4, in which said spaced patterns of cuts are opposed in mirror images of each other.

6. A package, as recited in claim 1, in which said stiff flat side is cut partially through in an interrupted cut pattern.

7. A package, as recited in claim 1, in which said stiff flat side is coated on at least one of its surfaces across said cut pattern with a sealant which, when said package is folded and the cuts in said pattern open, will rupture and allow the flowable substance to flow through said open cuts.

8. A package, as recited in claim 7, in which said sealant is a foil.

9. A package, as recited in claim 8, in which both surfaces of said stiff flat side of said package are coated with a sealant.

10. A package, as recited in claim 8, in which said foil is laminated to one side of said stiff flat side.

11. A package, as recited in claim 8, in which foil is laminated to the pocket side of said stiff flat side.

12. A package, as recited in claim 1, in which said cut pattern extends across said relatively stiff flat side at the center of said stiff flat side.

13. A package, as recited in claim 1, in which said cut pattern extends across said relatively stiff flat side at the middle of said package.

14. A package, as recited in claim 1, in which said cut pattern extends across said relatively stiff flat side at the middle of said pocket.

15. A dispensing package for a flowable substance, said package including a relatively stiff flat sheet and a flexible arched sheet secured to one side of said stiff flat sheet and forming between said stiff flat sheet, and said flexible arched sheet a pocket for containing a flowable substance, said relatively stiff flat sheet having a cut pattern so as to form at least one tongue and one opening when said relatively stiff flat sheet is bent into a V about an axis through the base of said tongue and in a direction about said axis toward said pocket so that said flexible arched sheet and said flowable substance in said pocket are between the arms of said V, said arms of said V and said flexible sheet therebetween cooperating, as said arms are forced toward each other, to apply pressure on said flowable substance in said pocket to force said flowable substance to flow from said pocket through said opening.

16. A package, as recited in claim 15, in which said cut pattern is an interrupted series of cuts forming a series of tongues extending across said stiff flat sheet.

17. A package as recited in claim 16, in which said interrupted pattern is repeated.

18. A package, as recited in claim 15, in which said stiff flat sheet is cut through in interrupted spaced cut patterns.

19. A package, as recited in claim 18 in which said spaced patterns of cuts are spaced in mirror images of each other.

20. A package as recited in claim 15 in which said stiff flat sheet is cut partially through in an interrupted cut pattern.

21. A package, as recited in claim 15 in which said stiff flat sheet is coated on at least one of its surfaces across said cut pattern with a sealant which, when said package is folded and the cuts in said pattern open, ruptures and allows the flowable substance to flow through said open cuts.

22. A package, as recited in claim 21, in which said sealant is a foil.

23. A package, as recited in claim 22 in which said foil is laminated to the pocket side of said stiff flat sheet.

* * * * *